US006484777B1

(12) United States Patent
Quinteros et al.

(10) Patent No.: US 6,484,777 B1
(45) Date of Patent: Nov. 26, 2002

(54) COMPACT DISC LABELER

(75) Inventors: Ernesto Quinteros, Los Angeles, CA (US); John Hoppe, Van Nuys, CA (US); Vijendra Nalwad, Thousand Oaks, CA (US)

(73) Assignee: Belkin Corporation, Compton, CA (US)

( * ) Notice: Subject to any disclaimer, the term of this patent is extended or adjusted under 35 U.S.C. 154(b) by 0 days.

(21) Appl. No.: 09/676,700

(22) Filed: Sep. 29, 2000

(51) Int. Cl.[7] ..... B65C 1/00; B65C 1/02

(52) U.S. Cl. ..... 156/391; 156/60; 156/556; 156/579; 156/580

(58) Field of Search ..... 156/391, 556, 156/579, 580, DIG. 24, 60

(56) References Cited

U.S. PATENT DOCUMENTS 4,497,682 A * 2/1985 Hamisch, Jr. ..... 156/384
4,549,922 A * 10/1985 Oishi et al. ..... 156/293
5,417,182 A * 5/1995 Fujii et al. ..... 118/503
5,783,033 A * 7/1998 Grossman ..... 156/556
6,148,891 A * 11/2000 Lee ..... 156/391

* cited by examiner

*Primary Examiner*—Richard Crispino
*Assistant Examiner*—Sue A. Purvis
(74) *Attorney, Agent, or Firm*—Bryan Cave LLP

(57) ABSTRACT

A method and apparatus is disclosed for applying a label to a compact disc having a first planar side, a second planar side, the compact disc defining an aperture having an axis bisecting the planes defined by the first side and the second side. The apparatus includes a planar surface defining an aperture, the planar surface for supporting a compact disc label to be affixed to the compact disc first planar side. The apparatus further includes a plunger, having a top surface, disposed within the planar surface aperture for reciprocal movement between a first position where the plunger top surface is above the planar surface and a second position that where the top surface is lower than in the first position with respect to the planar surface. The apparatus further defines means for attaching and holding a compact disc contacting at least a portion of the compact disc second planar side.

26 Claims, 8 Drawing Sheets

COMPACT DISC LABELER

FIELD OF THE INVENTION

The present invention pertains to the field of compact disc accessories and more particularly to devices used to apply labels to compact discs.

BACKGROUND OF THE INVENTION

Audio, visual and other data may be contained on disc media as a metallic coating etched or cut on a small disc in a pattern that can be read by a laser during disc rotation, for instance in the disc drive of a audio or video CD player or computer disc drive. Typically, the disc is referred to as a "compact disc" or "CD" though such discs may go by other names and vary as to their sizes. Common features are their circumferential etched or cut periphery and a concentric aperture for use in their placement and/or storage, e.g. where some retention/attachment system is used to grip them as with retainers in a CD case. For purposes of the invention, "compact disc," "disc," or "CD" are used interchangeably in this application to refer to any disc type audio, visual, or data media.

For those who create, inscribe, copy or "born" their own CD's, labeling these to distinguish their content or use is necessary for proper identification, especially given the different media and data formats which may be involved. Clearly, marking the CD for identification without affecting the content of the CD is important. Ink or wax marks made directly to the disc may disrupt the contents of the CD. Even if the marking is made to areas not etched or cut, the ink may still damage the disc or a wax constituent may not adhere to the disc during its playback or operation given the significant speeds of rotation the CD may be subjected in a disc drive.

In contrast, self adhesive labels are superior identification means, provided they are attached so as not to affect the circumferential load and, hence, the balance of the disc during rotation. It is therefore necessary for proper operation of the CD that the label be applied in a generally uniform manner concentric with and encircling the entire central portion surrounding the disc central aperture. Placing the label manually in such a fashion involves skill and coordination to avoid placing the label too far off-center or otherwise folding over or wrinkling the adhesive label so that a surface irregularity disrupts the rotational balance of the disc.

Human manual dexterity is simply too imprecise and subject to fatigue and other factors to consistently apply labels in a manner which consistently avoids impairing the operation of the disc. Other devices have been developed to affix a label to a compact disc. Some involve placing an adhesive label on a lower planar surface and using an apparatus to press a CD down on the label to affix it. Pressing downward on the CD to affix the label presents certain difficulties, however. Even if the apparatus can center the label properly, uniform pressure so that the label affixes evenly around the surface of the disc may require contacting much of the CD surface, and potentially damaging/the disc itself or the etched metallic surface. If uniform pressure is not applied, however, bubbles, wrinkles and other irregularities may result which need to be smoothed out after application.

Some devices incorporate a supporting surface biased to resist downward pressure, the surface supporting a label placed adhesive side up. The bias force allows some movement to the surface in response to downward pressure. Nonetheless, applying a bias in a uniform manner over the area of a surface may prove difficult under normal wear and tear of repeated use. Electrical or mechanical methods to support the surface evenly are prone to losing alignment. Compression against a spring bias still requires an even downward force, which invokes again the imprecision of manual dexterity. Moreover, the means. for attachment of the CD must be sufficiently snug to hold the CD in place during the pressing stage, yet flexible enough to allow easy removal of the CD.

What is needed is a CD labeler mechanism which quickly affixes a label to a CD which minimizes the need for manual dexterity and yet is reliably over protracted periods of use.

SUMMARY OF THE INVENTION

An apparatus and method is disclosed for applying a label to a compact disc. The apparatus works on a compact disc having a first planar side and a second planar side, the compact disc defining a central aperture having a diameter and a circumference, and the apparatus comprises a planar surface defining an aperture, the planar surface for supporting a compact disc label to be affixed to the compact disc first planar side, a plunger, having a top surface, disposed within the planar surface aperture for reciprocal movement between a first position where the plunger top surface is above the planar surface and a second position that where the top surface is lower than in the first position with respect to the planar surface, means for attaching and holding a compact disc, the means for attaching and holding engaging the compact disc central aperture circumference at a portion of the means defining a diameter larger than the diameter of the compact disc central aperture, the means coupled to the plunger top surface, and means for reciprocating the plunger from the first position to the second position such that the attachment means draws the compact disc first planar side to contact the label supported by the planar surface.

The method involves affixing a self adhesive label to a CD having an aperture, a top surface and a bottom surface, comprising the steps of affixing a CD to a shaft having an upper and a lower end, the shaft extending through the CD aperture, the shaft having a lip on its upper end contacting the CD top surface, engaging the shaft lower end to a source of downward pulling force, with the downward pulling source, pulling the shaft downward toward a surface bearing the self adhesive label such that the lip exerts a downward force on the CD top surface impelling the CD toward the surface, and contacting the CD bottom surface with the self adhesive label so as to affix the label to the CD.

An apparatus for removing the compact disc from its affixation to the labeler is also disclosed comprising a first segment engaging the compact disc central aperture circumference at a first point, a second segment engaging the compact disc central aperture circumference at a second point on a diametric axis, the second point approximately opposed to the first point, at least one brace having a retraction point, the brace operatively coupling the first segment to the second segment over the diametric axis such that contacting the brace retraction point with a force impels the first segment away from the first point and impels the second segment away from the second point, and means for contacting the retraction point.

DETAILED DESCRIPTION OF THE INVENTION

Figure 1:
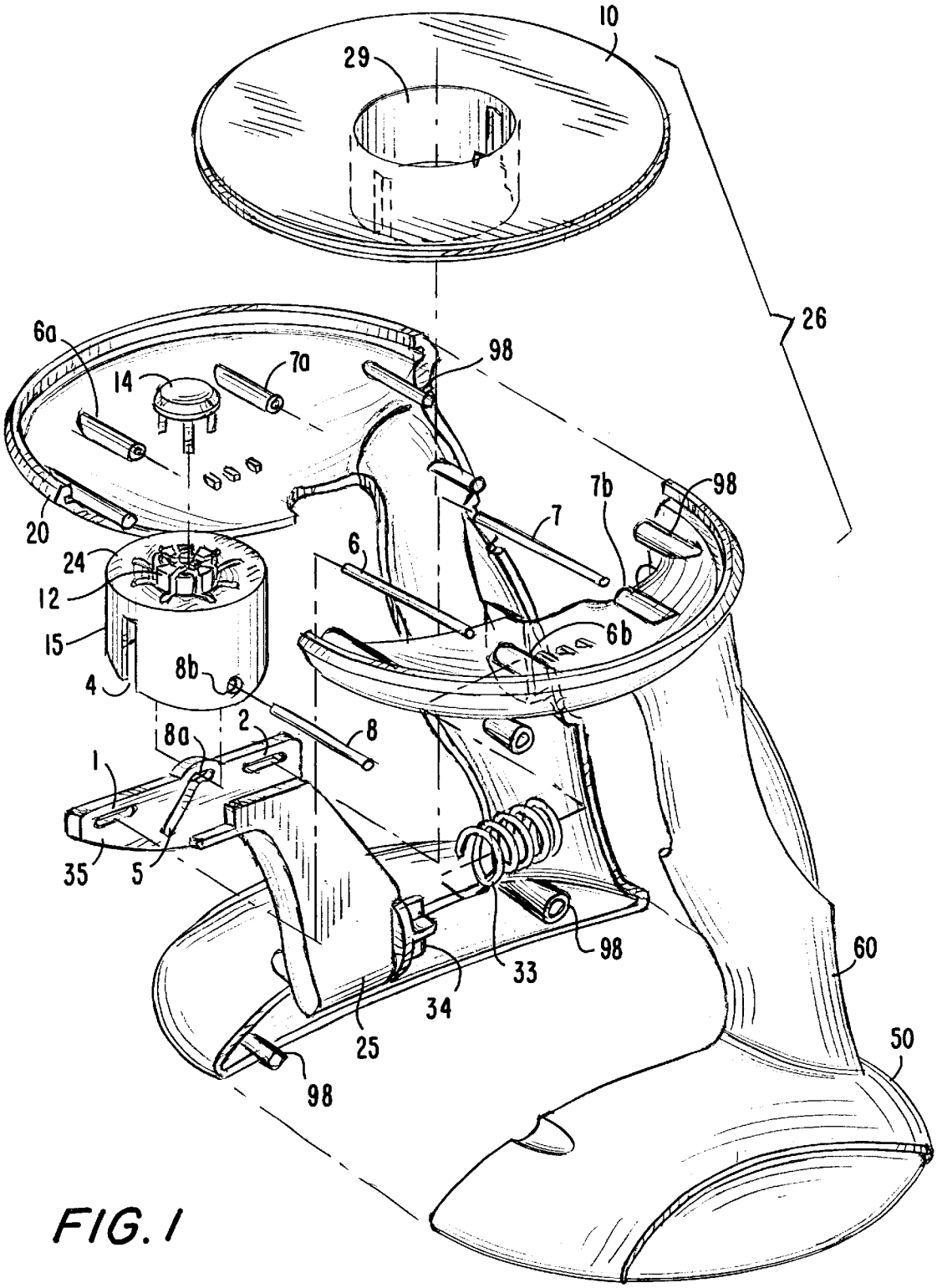
FIG. 1 illustrates an exploded view of one embodiment of the invention showing the various components of the embodiment.

FIG. 1 is an exploded view of one embodiment of the invention illustrating its various components. CD labeler 26 includes stand 50, arm 60 coupled to stand 50, and surface support 20 coupled to arm 60. These elements may be integral and composed of two molded halves fitted together at connectors 98. Plate 35 and integral trigger 25 fit within CD labeler 26 such that plate 35 is disposed within surface support 20 and trigger 25 is disposed within arm 60. Arm 60 defines an opening (not pictured) where the trigger emerges from arm 60, while spring support member 34 of trigger 25 located within arm 60 engages spring 33 which is also contained within arm 60.

Plate 35 includes apertures 1 and 2 through which pins 6 and 7 extend. In surface support 20, pin holes 6*a* and 6*b* and 7*a* and 7*b* hold pins 6 and 7 in place. Plate 35 also includes a central slot 5, including ledge 8*a*. Plunger 15 is coupled to plate 35 by pin 8 disposed through plunger 15 at rod opening 8*b* and at a corresponding opposing rod-opening (not pictured) of plunger 15. Rod 8 extends through central slot 5 and occupies ledge 8*a*. Plunger 15 includes plunger surface 24, lip 12 and coupled button 14. Surface 10 fits around plunger 15, which is disposed within surface central aperture 29, and engages surface support 20.

Figure 2:
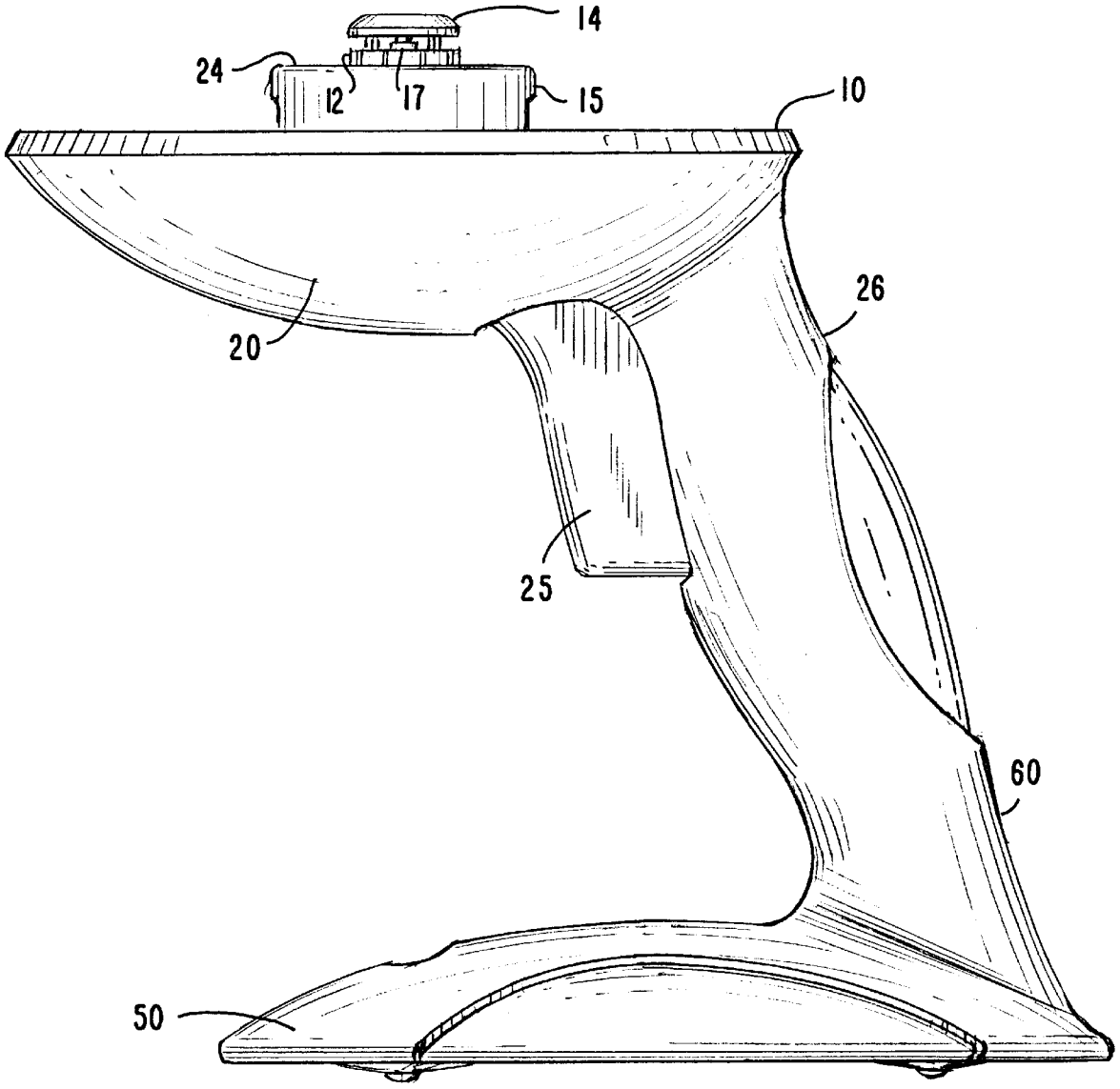
FIG. 2 illustrates a side view of the embodiment shown in FIG. 1.

FIG. 2 illustrates a side view of one embodiment of the invention showing stand 50, arm 60, trigger 25, surface support 20, surface 10, plunger 15, lip 12, shaft 17 and button 14. CD labeler 26 may be made of polypropylene or similar polymer material, in fitted molded piece sections. Although a particular plastic or other material is not critical to the operation of the invention, certain plastics utilizing a low co-efficient of friction, such as acetal resins marketed under the trade name DELRIN by DuPont Engineering Polymers, may be used for certain moving parts to add resiliency. Arm 60 may be contoured in any of numerous ways to fit comfortably into a user's hand, providing stability and support during operation as well as portability, and allowing the user to comfortably retract trigger 25. Stand 50 provides support during use and may be configured in various ways, only one of which is illustrated in FIG. 1.

The embodiment illustrated in FIGS. 1 and 2 is but one example of one possible embodiment and configuration of the invention. It will occur to those skilled in the art that modifications may be made to provide additional comforts and efficiency of use to various users depending on the context of use. Designs which enhance aesthetic appeal of the invention over the functional features may also be adopted. In addition, adaptation for commercial use are possible. For instance, where the device will be used repeatedly in given intervals over a long time period, for instance, during a mass-production operation, the stand may be configured to be affixed to a surface or the arm may be attached to a table like surface itself, or the base may comprise or be attached to an adjustable surface or moveable arm to allow readjustment and repositioning according to user preference, e.g., to minimize arm and hand strain over time. Likewise, arm 60 may be configured to be adjustable in height or flexible to provide a wide range of placement possibilities. Similarly, surface 10 may be suspended by arm 60 over stand 50, as shown in FIG. 2, or may be adjustable, either with or separate from arm 60, or may be affixed or comprise a larger work surface, e.g. a common work surface with other labeler operators. Trigger 25 for operation of the labeler, need not be on arm 60, but may be placed in a more remote position or even separate from the labeler, e.g. in or under a work surface, for instance, to provide numerous stations along an assembly line. As will be demonstrated, elements of the invention will apply equally to these and other possible configurations and are within the scope and contemplation of the invention. Some features depicted in FIG. 2, e.g. the shape and contour of labeler 26 may also be stylized for aesthetic appeal.

Surface 10 includes a central aperture 29 through which plunger 15 extends upwardly and within which plunger 15 is vertically moveable, i.e. upward and downward, with respect to surface 10. It is preferred that the central aperture 29 of surface 10 be approximately as large as the size of a CD label aperture. CD labels are typically donut shaped, with an aperture concentric to the central aperture of a CD. The approximate diameter size of the label hole is about 1.60 inches; consequently, the diameter of plunger 15, and of plunger surface 24, is approximately equal to this. It is to be appreciated, that the CD labeler of the present invention may be tailored to sizes which utilize either customized or non-standard size CDs and/or CD labels.

Plunger 15 is preferably cylindrical in shape, with a diameter slightly smaller than the label hole so that the label can be applied to surface 10 and fit around plunger 15, disposed in surface central aperture 29 of surface 10. The outside circumferential edge of plunger 15 may thus be used as a guide to placement and centering of the CD label which fits around it. Plunger 15 is coupled to trigger 25 which controls its upward and downward movements. In its operation, as illustrated in the embodiment shown in FIG. 1, absent illustration of a CD workpiece, retraction, e.g. squeezing, trigger 25 pulls plunger 15 down toward surface 10 and into the surface central aperture 29 (not pictured in FIG. 2), to the point that plunger surface 24 is at least co-planar with surface 10, and possibly slightly lower than the planar surface defined by surface 10. A slightly lower disposition of plunger base 24 below the planar surface defined by surface 10 may be employed to increase the force with which a CD attached to lip 12 contacts and impresses upon surface 10, where a label for attachment to the CD will be disposed, with its label adhesive side up. A CD is attached to lip 12 by inserting lip 12 through the CD central aperture, thus lip 12 engages the inner circumference of a CD and affixes the CD in ways that will be further described.

Even at the lowest point reached by plunger 15 as it moves downward into the surface central aperture 29, at least a portion of lip 12 remains either co-planar with or above surface 10 during operation. Lip 12, with attached CD, pulls the CD downward along with plunger 15; to the degree lip 12 moves toward surface 10 and the closer it comes to surface 10, the CD workpiece attached to lip 12 will be subjected to a proportionate downward force exerted at the point where lip 12 engages the inner circumference of the CD within the CD aperture, and, with the CD firmly affixed to lip 12, and translating over the periphery of the CD in a generally even manner. This promotes the uniform affixation of the self adhesive label on surface 10 and dispenses with the compensation which may be required of a user applying downward manual pressure, for instance against an upwardly directed opposing spring bias, to ensure uniform force over the CD surface where it contacts the label, to enable proper affixation. In one embodiment of the invention, plunger 15 lowest downward position may be adjustable to regulate the downward force applied to the CD and to accommodate differing thicknesses of surface 10 (or any material disposed thereon). Moreover, as will later be described, another embodiment may utilize an intervening cushion placed on surface 10 which bears the self adhesive label.

In operation on a CD workpiece, a self adhesive CD label is placed on surface 10, adhesive side up. Plunger 15 is configured to extend through the label hole, and is thus preferably designed to have a diameter approximately the size of a standard CD label. Plunger 15, however, need not be strictly round; a square or rectangular shape, as well as other shapes, are within the scope and contemplation of the invention, so long as sufficient surface area on the top surface of plunger base 24 exists to accommodate lip 12 (which also may be of varying shape) and, in one embodiment, sufficient surface area on the plunger surface 24 exists on which a CD released from lip 12 may rest without contacting surface 10. Surface 10 is preferably of a size to accommodate a standard CD label size. Consequently, a CD is affixed to lip 12, with the CD side which will receive the label facing downward toward surface 10.

Lip 12 employs a means of attaching the CD through the standard CD central aperture. In the embodiment illustrated in FIG. 2, lip 12 is a cylindrical extension rising vertically from the surface of plunger surface 24 having a circumference, and hence a diameter, that is slightly larger than the standard CD central aperture circumference and/or diameter, requiring lip 12, which may be fashioned of a flexible polymer material such as polypropylene, to flexibly distort inward toward the circumference center to fit through a CD aperture. For instance, lip 12 may have at least a portion or segment defining a diameter of 0.61 inches, where the approximate size of a standard CD aperture is 0.591 inches. The degree of flexibility of lip 12 may be varied depending on the material used. As will be later discussed, in one embodiment, lip 12 may be flanged about a portion of the top circumference to assist in securing the affixed CD and/or may include other protrusions such as snaps about a portion of the circumference to hold the CD.

Lip 12 may also be an insertable pin, rod, shank or screw, detachably coupled to the plunger base according to fastening means known to the trade, and which may be removed from the plunger base to insert a CD thereon and then reattached through the CD aperture to the plunger base and fastened securely. Lip 12 and shaft 17, with button 14 atop shaft 17, extend upwards above plunger surface 24 and are fixably attached thereon so as to move along with plunger 15. Retracting trigger 25 pulls coupled plunger 15 downward within surface central aperture 29, impelling the engaged CD toward surface 10, where the label is placed, adhesive side up. As plunger surface 24 approaches and becomes co-planar with surface 10 and/or moves below the plane of surface 10, the CD affixed to lip 12 contacts the label adhesive side, placed on surface 10. The force exerted by plunger 15 downward pulls lip 12, and hence affixed CD, downward and impels the CD against the label disposed on surface 10. As lip 12 securely holds the CD, the CD is contacts the label with sufficient force to adhesively affix the label to the CD. Release of trigger 25 allows the plunger 15 to return to its upwardly extended position, along with the engaged CD and label, where the CD may be removed from lip 12. In the illustrated embodiment, removal of the CD from lip 12 can be accomplished by pressing button 14, as will be further described and illustrated.

In a separate embodiment, a flexible surface, such as a polymer foam, may be placed over surface 10 to cushion contact between the label and CD, hence plunger 15 need not travel down so far that plunger surface 24 is co-planar with surface 10, but need only be lowered to the point that the CD contacts the label suspended above surface 10 sufficiently to adhere the label thereto. Other such embodiments, where plunger 15, and consequently lip 12, may be depressed sufficiently for the CD to contact with a label disposed above surface 10 will occur to those skilled in the art and would be within the scope and contemplation of the invention.

Figure 3:
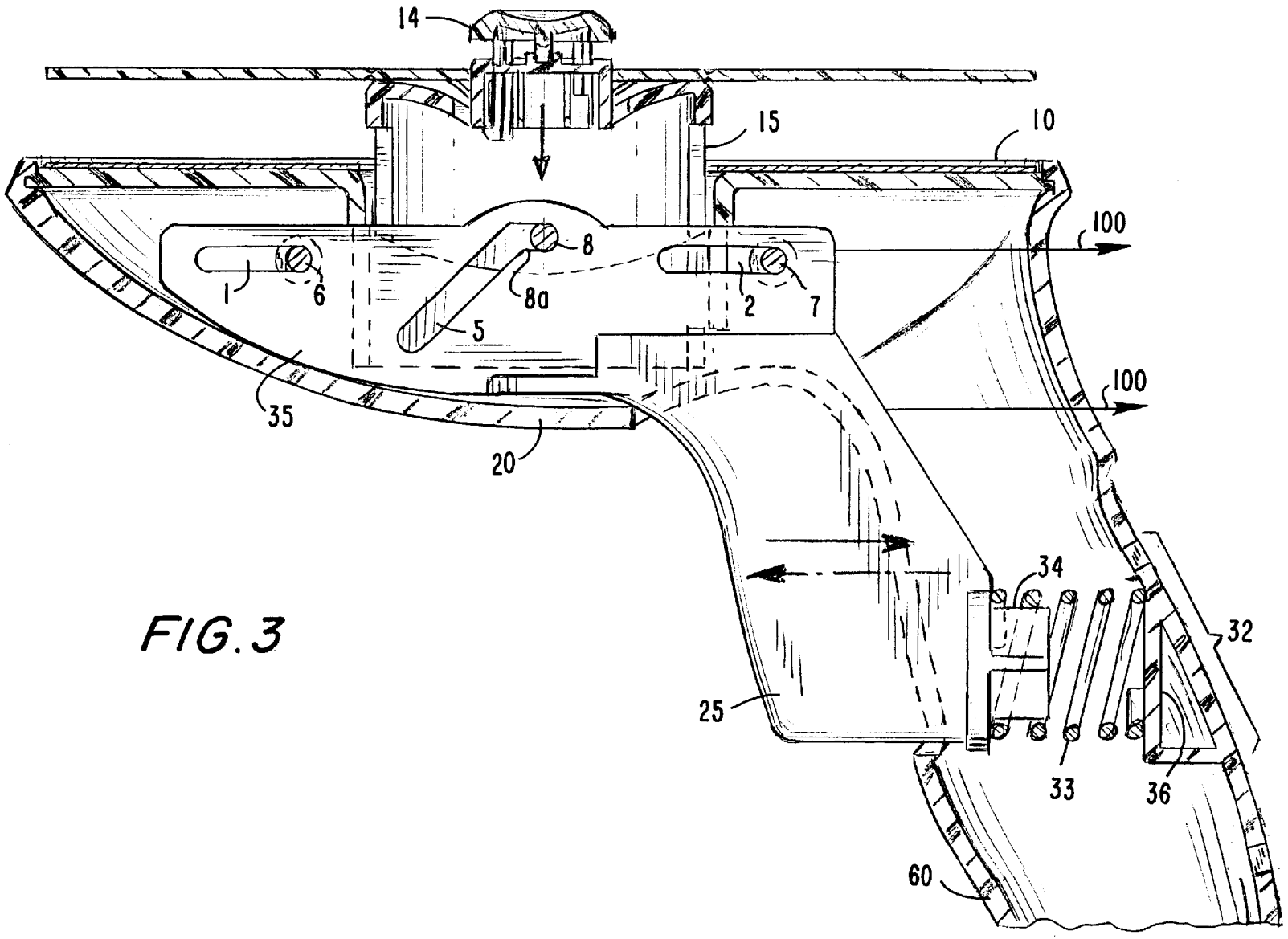
FIG. 3 illustrates a cutaway side view of the embodiment shown in FIG. 1.

FIG. 3 shows a cutaway view of the invention, especially arm 60 and surface support 20. Trigger 25, disposed in arm 60, is coupled to plate 35 within surface support 20. Plate 35 defines plate apertures 1 and 2 and central slot 5. Plunger 15 fits atop plate 35, which is received in plunger plate slot 4. Rod 8 connects plunger 15 to the pathway defined by central slot 5 and rests atop ledge 8*a*, supporting plunger in an upwardly extended position. Plate 35 includes rods 6 and 7 each of which fit through one of support apertures 1 and 2, respectively, and engage surface support 20 at holes 6*a* and 6*b*, as well as 7*a* and 7*b*, respectively (holes pictured in FIG. 1). Rod 8 moves within a pathway defined by central slot 5, which may be diagonally sloped with ledge 8*a* at the highest extent of slot 5. Where rod 8 occupies ledge 8*a*, plunger 15, and elements coupled thereto, necessarily sits at a point extending above surface 10. Where rod 8 moves to bottom of central slot 5, the plunger depresses to a position where plunger surface 24 may be at least co-planar to surface 10, or the label, if the label is suspended above surface 10, and possibly slightly below the plane of surface 10, or the label, to provide additional force to affix the label on the CD.

Trigger 25 is biased outward by spring mechanism 32 and is coupled to plate 35. In the embodiment shown, spring mechanism 32 comprises spring 33 trigger spring holder 34 and arm spring holder 36 to brace and support spring 33 compression. When pressed, trigger 25 moves against the outward biasing force of spring 33 and spring mechanism 32, pulling coupled plate 35 in a lateral direction toward arm 60 in the direction of arrows 100 such that slot 5 likewise moves laterally, forcing rod 8 to move off ledge 8a and down the pathway defined by central slot 5 to a lower position, with the result that plunger 15 sitting atop rod 8 moves downward as well. Where rod 8 reaches a sufficiently lower position within the pathway defined by central slot 5, plunger 15 reaches a position where surface 10 may contact and press against a compact disc attached to lip 12. Thus, lateral movement of plate 35 and central slot 5 causes downward movement of rod 8, resulting in plunger 15 moving downward through the surface central aperture 29 and toward surface housing 20. Rods 6 and 7 are at either end of plate 35, through apertures 1 and 2, respectively, to limit the lateral progress of plate 35 within surface support 20. Release of trigger 25 also releases spring 32, the opposing bias force of which impels trigger 25 back outward moving plate 35 to its original position, forcing rod 8 up the pathway defined by central slot 5 and onto ledge 8*a* where it rests, consequently raising plunger 15 resting atop rod 8. As such, plunger 15 reciprocates between a lower position and an upwardly extended position. As ledge 8*a* prevents downward motion of rod 8 and, hence, plunger 15, unless trigger 25 is pressed, plunger 15 remains in its upwardly extended position and resists any downward pressure, including manual pressure that may be applied, which may otherwise impel plunger 15, and an engaged CD toward surface 10.

Other means of operation aside from a spring biased trigger mechanism will occur to those skilled in the art. For instance, a separate embodiment may include a latch trigger mechanism. Alternatively, electric means could be used to move plate 35 or plunger 15, for that matter, the requisite distances. A plug to a power source or a small electric cell may power movement of plate 35 and/or plunger 15 according to control means known in the art, e.g. activated by a button or knob.

Figure 4A:
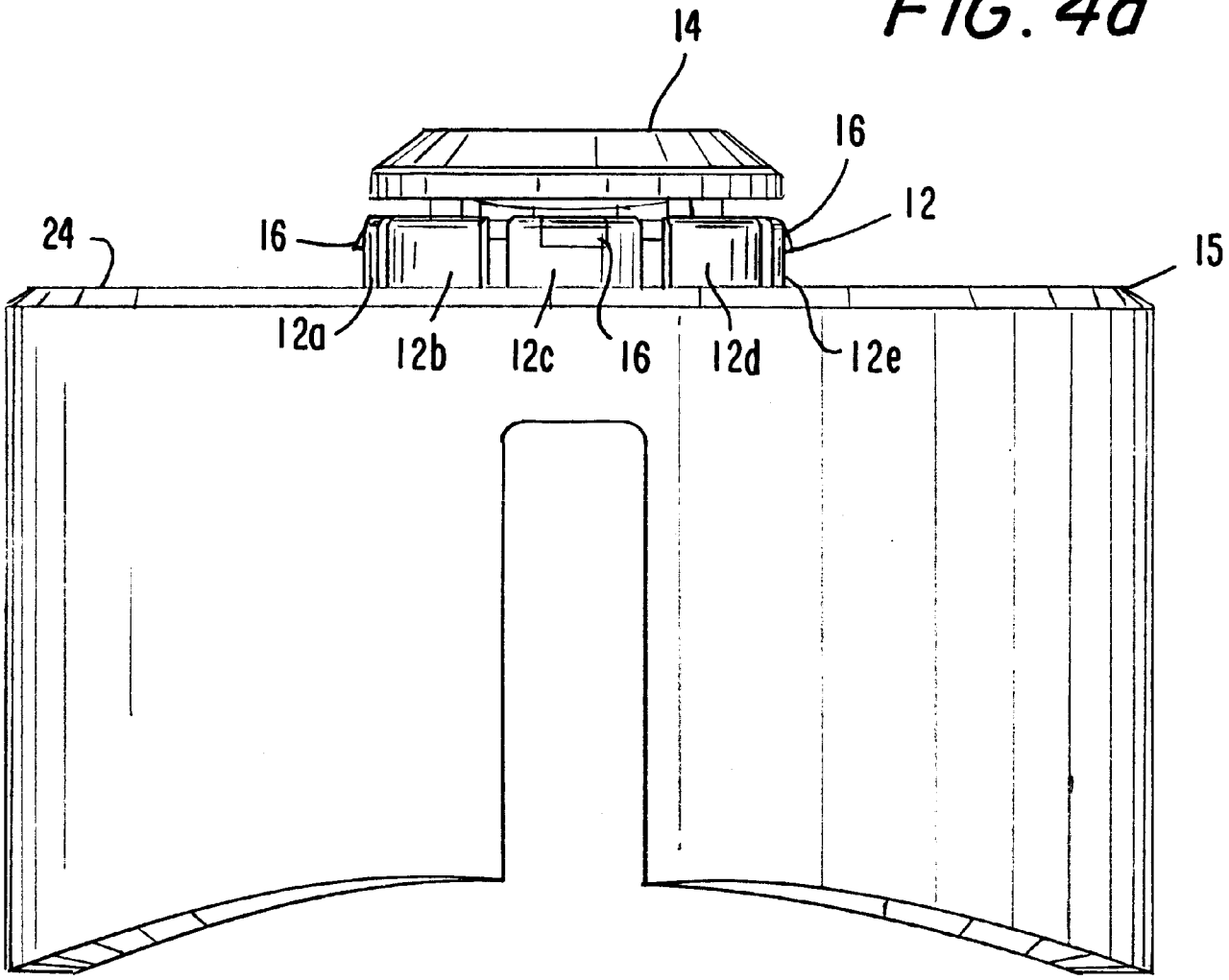
FIG. 4*a* illustrates a side view of the plunger of the embodiment shown in FIG. 1.
Figure 4B:
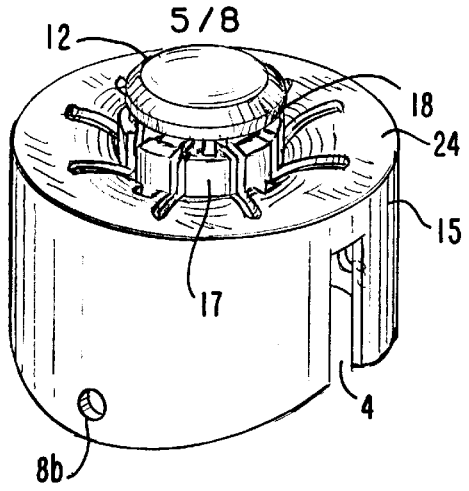
FIG. 4*b* illustrates a perspective view of the plunger of the embodiment shown in FIG. 1.

FIGS. 4*a* and 4*b* shows alternate side views of plunger 15 and illustrate plunger surface 24, rod opening 8*b*, plate slot 4, lip 12, shaft 17 and button 14. In FIG. 4*a*, lip 12 is divided into segments 12*a*–12*e*, (others are not pictured in FIG. 4*a*) some of which segments include snaps 16. The CD central aperture fits over lip 12, and lip segments 12*a*–12*e*, and are locked in by one or more snaps 16 spaced about at least a portion of the circumference of lip 12 to secure the CD into place. Snaps 16 are surface irregularities on some or all lip 12 segments, that are received through the CD aperture to anchor the CD onto lip 12. In the illustrated embodiment, snaps 16 gradually taper from their uppermost portion to an edge protruding a pre-determined distance out from lip 12. As lip 12 fits through the CD aperture, the CD inner circumference defining the aperture moves over the gradually tapered portion of snaps 16 to move into place at or over the edge of snap 16 at which point the CD is held on lip 12. The CD may be affixed by pressure exerted by snaps 16 (which are protrusions extending the diameter of lip 12 slightly beyond the CD aperture diameter) where the CD occupies the edge of the snaps, or, alternatively, the CD aperture fits over snaps 16 and is then disposed on lip 12 between snaps 16 on the upper side and plunger surface 24 on the lower side. In one embodiment, the CD may rest on plunger surface 24 before it engages a label disposed on or above surface 10.

In another embodiment, flanging of the lip upper portion may substitute for snaps 16, or a combination of snaps and flanging may be used. Other similar means known in the trade of slightly increasing lip circumference and/or locking a CD inserted over lip 12 will occur to those skilled in the art, e.g. clips, ridges, threads, styrations, channels, grooves or combinations thereof.

Where lip 12 and/or snaps are made of a sufficiently resilient material, the necessary flexibility to contract lip 12 to fit snaps 16, or other attachment device, through the CD aperture may be accomplished. In this regard, the lip may be divided into individual segments 12*a*–12*e*, one or more of which including snaps 16, each segment being separately flexible with respect to the others, to ease distortion of lip 12 and snaps 16 during affixation and removal of the CD. Segments 12*a*–12*e* may be made of semi-flexible polypropylene material with a resilience sufficient to alternatively distort and return to their original form in response to the placement and removal of CDs. Use of segments 12*a*–12*e*, as well as other not pictured, when used to comprise the circumference of lip 12, allows lip 12 circumference to be flexible, allowing it to be inserted through a CD aperture despite its slightly larger diametric and circumferential size with respect to the aperture.

FIG. 4*b* illustrates plunger plate slot 4 which is configured to receive plate 35 where plunger 15 depresses within central slot 5. Also, rod opening 8*b* receives one end of rod 8, which extends through plate 35 at central slot 5, is shown. A second rod opening (Not pictured) occupies the diametrically opposite side of plunger 15 allowing rod 8 to extend across the diameter defined by the cylindrical plunger shape, in the preferred embodiment. Note, while plunger 15 is depicted in this embodiment in a round, cylindrical shape, as previously explained, other shapes and configurations may be adopted without impairing plunger function. The cylindrical configuration is advantageous in that the circumferential sides of a CD label fitted on surface 10 are guided by the outside circumferential edge of plunger 15, to assist in holding the label in place.

Figure 5A:
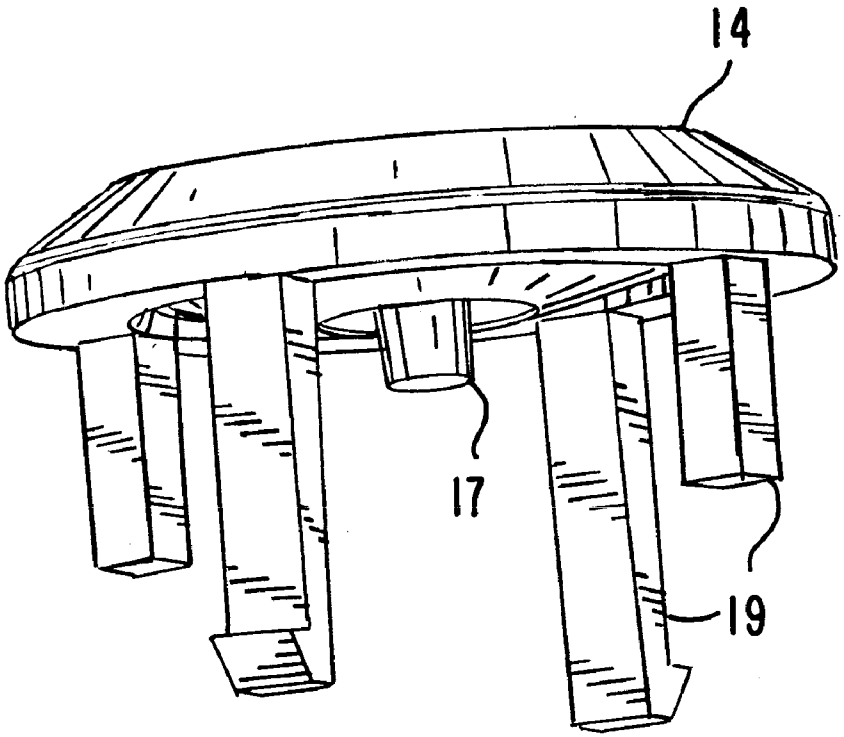
FIG. 5*a* illustrates a perspective view of the button of the embodiment shown in FIG. 1.
Figure 5B:
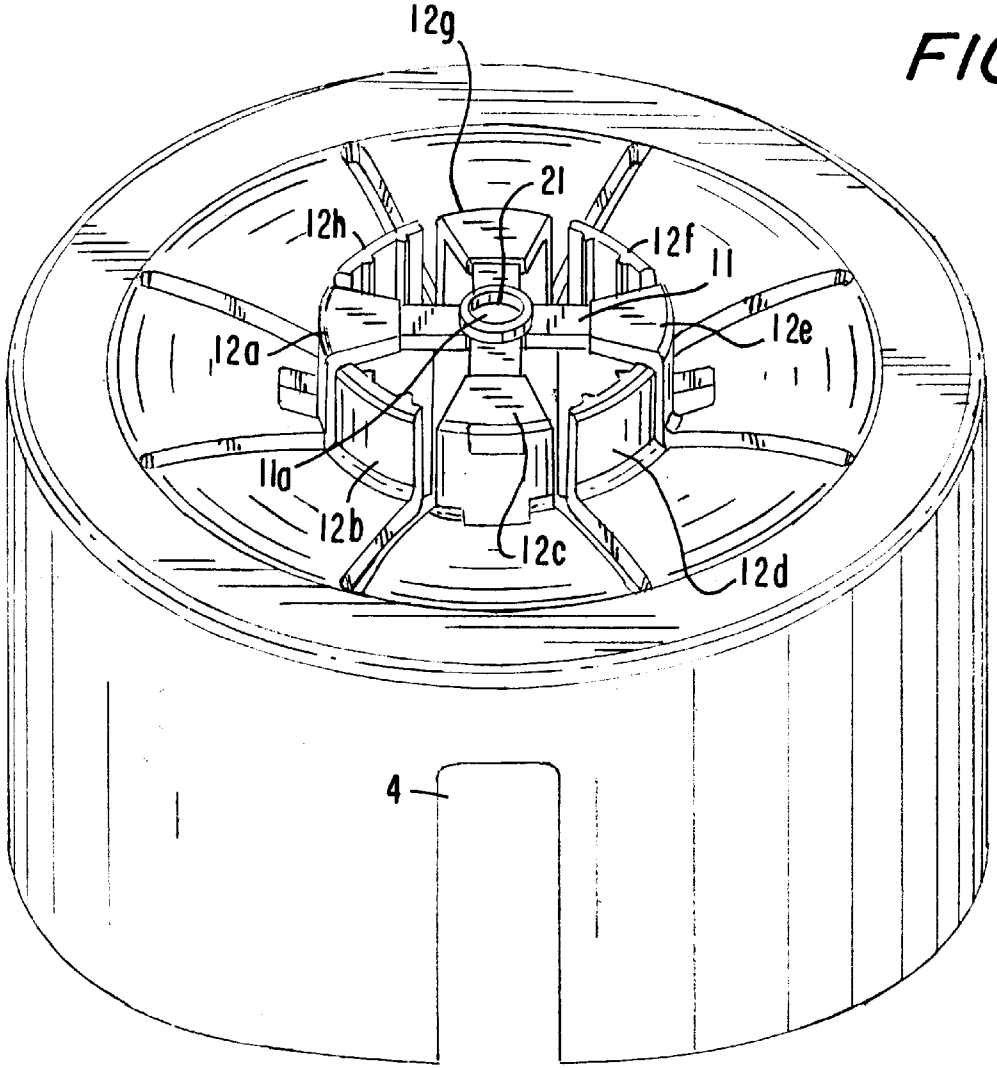
FIG. 5*b* illustrates a perspective view of the plunger of the embodiment shown in FIG. 1 absent the button.

FIG. 5*a* illustrates button 14 used to release a CD from lip 12. Button 14 includes shaft 17 extending downward from button 14 a pre-determined distance. Legs 19 affix the button to plunger 15 at plunger top surface 24. FIG. 5*b* illustrates plunger 15 and plunger surface 24. Lip segments 12*a*–12*h* represent segments of which two sets, 12*a*, 12*e* and 12*c*, 12*g* include snaps 16 and are positioned diametrically opposite at positions along lip 12 circumference. Lip segments 12*a*, 12*e* and 12*c*, 12*g* are linked by diametric braces 11, intersecting at center point 11*a*, where slot 21 is defined. Shaft 17 is disposed within slot 21. Downward pressure applied to button 14 forces shaft 17 downward in slot 21 and depresses center point 11*a*, which, by its depression, downwardly distorts braces 11 to pull lip segments 12*a*, 12*e* and 12*c*, 12*g* toward center point 11*a*, thus decreasing the circumference of lip 12 and allowing a CD affixed to lip 12 to be lifted from or over snaps 16 and be removed.

Note, as button 14 is suspended by shaft 17 above lip 12, button 14 does not contact the CD which is affixed to lip 12 below the flanged edge. Thus, no downward pressure on the CD itself, or the portion proximate to the CD center or CD central aperture circumference, is used to release the CD from labeler 26, hence no distortion of the CD itself is necessary to remove the CD, avoiding potential warpage or other damage to the CD.

Figure 6:
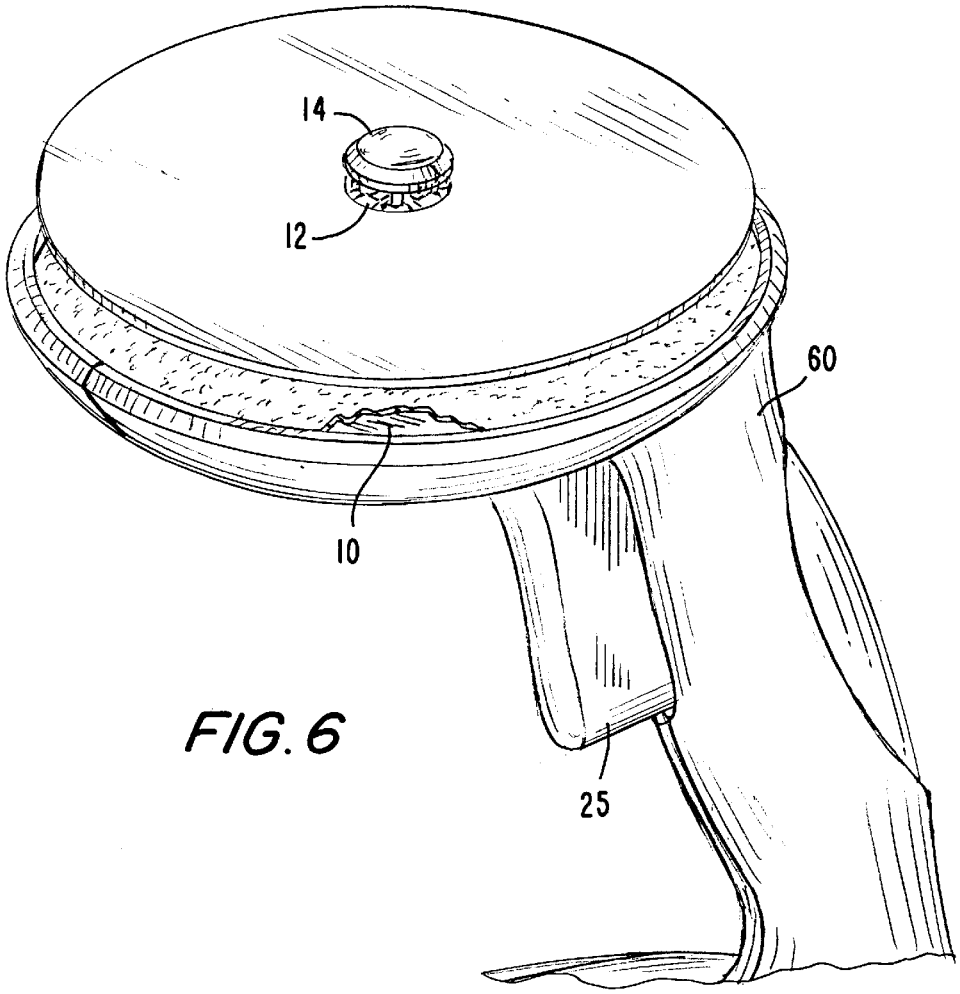
FIG. 6 illustrates the invention shown in FIG. 1 with a compact disc attached and the plunger in a raised position.
Figure 7:
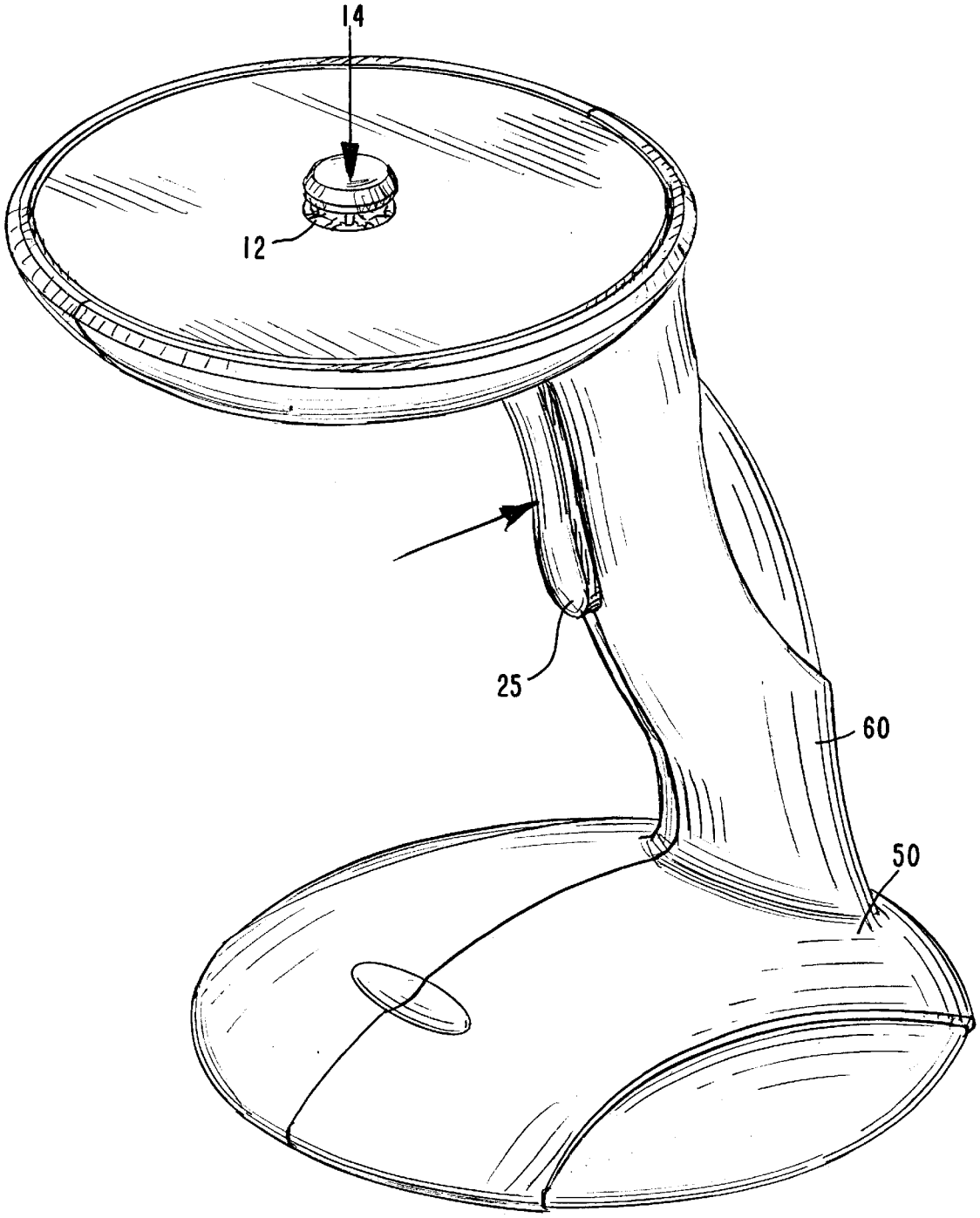
FIG. 7 illustrates the invention shown in FIG. 1 with the compact disc contacting the surface upon which a label would be disposed.

FIG. 6 illustrates a CD attached to lip 12 and suspended above surface 10 by plunger 15 (not visible in FIG. 6). As stated previously, attachment of the CD may be through inserting lip 12 through the CD aperture and on snaps 16 suspending it: above plunger surface 24 or, alternatively, after insertion over snaps 16, and be held on lip 12 under snaps 16 or the CD may rest on the plunger surface 24. A label to be affixed to the CD is placed adhesive side up on surface 10. When trigger 25 is depressed, FIG. 7 illustrates the CD lowered onto surface 10 by the downward movement of plunger 35. The action of the plunger downward forces the CD to contact surface 10, where the CD is held in place on lip 12. The pressure provided by lip 12 being lowered by plunger 15 provides generally uniform pressure about the circumference of the CD in contacting the adhesive label, thus reducing the likelihood of bubbles forming or of the label not adhering properly. Releasing trigger 25 brings the plunger back to its upper position above surface 10 and allows the CD to be removed, by pressing button 14 in the preferred embodiment, with the CD bearing the attached label.

Although the invention has been described in relation to specific embodiments, other variations and modifications will become apparent to those skilled in the art and the claims are intended to cover all embodiments falling within the true spirit and scope of the invention.

What is claimed is:

1. An apparatus for applying a label to a compact disc having a first planar side and a second planar side, the compact disc defining a central aperture having a diameter and a circumference, the apparatus comprising:

a planar surface defining an aperture therein, the planar surface being capable of supporting a compact disc label to be affixed to the compact disc first planar side;

plunger means, having a top surface, disposed within the planar surface aperture for reciprocal movement between a first position where said plunger means top surface is above the planar surface and a second position where the top surface is lower than in the first position with respect to the planar surface;

means for attaching and holding a compact disc, the means for attaching and holding the compact disc engaging the compact disc central aperture circumference at a portion of the attaching and holding means defining a diameter larger than the diameter of the compact disc central aperture, the attaching and holding means coupled to the plunger top surface;

means for reciprocating the plunger means from the first position to the second position such that the attaching and holding means draws the compact disc first planar side to contact the label supported by the planar surface.

2. The apparatus of claim 1, further comprising flexible lip coupled to the plunger means top surface and the attaching and holding means portion comprises diametrically opposing segments on the flexible lip.

3. The apparatus of claim 1, wherein the plunger means top surface defines a hole and the compact disc attaching and holding means is a pin coupled to the plunger means and disposed within the plunger means top surface hole.

4. The apparatus of claim 1, wherein the means for reciprocating the plunger means is a spring biased trigger coupled to the plunger means regulating the movement of the plunger means between the first position and the second position.

5. The apparatus of claim 4, wherein the trigger is part of a trigger mechanism which comprises a trigger coupled to the plunger means, a spring imparting a bias force against the trigger and a spring holder coupled to the trigger engaging the spring.

6. An apparatus comprising:

a plate having an upper portion and a lower portion, the plate defining a plate slot, the slot defining a pathway between the plate upper portion and the plate lower portion, the plate configured to reciprocally move between a first plate position and a second plate position;

a planar surface defining a central aperture, the planar surface for receiving a compact disc label, the planar surface coupled to the plate top portion;

a plunger disposed within the planar surface central aperture having a plunger top portion and a plunger lower portion, the plunger lower portion received within the plate slot so as to move the plunger along the pathway between a first upper plunger position where the plunger top portion is above the planar surface when the plate occupies the first plate position and a second lower plunger position when the plate occupies the second plate position;

means coupled to the plate for reciprocally moving the plate between the first plate position and the second plate position; and, means for affixing a compact disc to the plunger top portion such that when the plunger occupies the second plunger position, the compact disc contacts a compact disc label disposed above the planar surface.

7. The apparatus of claim 6, wherein the means for reciprocally moving the plate is a spring biased trigger coupled to the plate.

8. The apparatus of claim 7, wherein the spring bias trigger is part of a mechanism which comprises a trigger coupled to the plate, a spring coupled to the trigger for imparting a bias force against the trigger, and a spring holder coupled to the spring.

9. The apparatus of claim 6, wherein the means for affixing a compact disc to the plunger top portion comprises a flexible lip coupled to the plunger top portion for insertion in to an aperture of the compact disc.

10. The apparatus of claim 6, further comprising a plate housing coupled to the plate and an arm coupled to the plate housing, the arm housing a spring bias mechanism.

11. The apparatus of claim 10, wherein the plate support defines a first set of opposing slots and a second set of opposing slots and the plate defines a first aperture and a second aperture, and the apparatus further comprises a first rod having two ends and a second rod having two ends, the first rod disposed through the plate first aperture, one of each of its ends disposed within the first set of opposing slots and the second rod disposed through the plate second support aperture, its ends each disposed within the second set of opposing plate support slots.

12. The apparatus of claim 11, wherein the second plate position corresponds to the point where movement of the plate is hindered by the plate contacting either of the first rod disposed in the first plate aperture and the second rod disposed in the second plate aperture.

13. The apparatus of claim 6, wherein the plunger top portion is co-planar with the planar surface when the plunger occupies the second lower plunger position.

14. The apparatus of claim 6, wherein the plunger top portion is below the plane of the planar surface when the plunger occupies the second lower plunger position.

15. The apparatus of claim 6, wherein the plunger has an inner circumference and the plunger lower portion comprises a diametric rod extending across the plunger inner circumference, the diametric rod disposed within the plate slot and regulating movement of the plunger lower portion in the plate slot.

16. The apparatus of claim 15, wherein the plate slot comprises an upper ledge for receiving the plunger diametric rod to allow the plunger to remain in the first upper plunger position.

17. A compact disc labeler apparatus comprising:

a base;

an arm coupled to the base;

a plunger housing coupled to the arm and suspended above the base;

a surface for receiving a label, coupled to the plunger housing, the surface defining a central aperture;

a plunger having a top segment, the plunger disposed within the surface central aperture and moveable between a first position within the plunger housing and a second position above the plunger housing;

a spring bias trigger disposed within the arm, coupled to the plunger to regulate movement of the plunger between the first position and the second position;

means for attaching a compact disc having a central aperture to the plunger top segment.

18. The compact disc labeler of claim 17, wherein the means for attaching a compact disc to the plunger top segment is a circular flexible lip having a circumference larger than the compact disc central aperture.

19. The CD labeler of claim 17, wherein the plunger housing defines a slot oriented along a vertical plane having a bottom portion and an upper ledge and wherein the plunger, when in the second position, rests on the ledge, and when in the first position, is disposed within the slot bottom portion.

20. The CD labeler of claim 19, wherein the trigger is coupled to the plunger housing such that when the trigger is pulled the slot is moved so as to dislodge the plunger from the second position on the slot ledge to the first position on the slot bottom.

21. The CD labeler of claim 20, wherein the trigger is pressure sensitive such that selective application of pressure to the trigger to partially depress it disposes the plunger within a third position disposed between the slot ledge and the slot bottom.

22. The CD labeler of claim 21, wherein continuing to depress the trigger maintains the plunger in the first position and release of the trigger returns the plunger to the second position.

23. A method for affixing a self adhesive label to a CD having an aperture, a top surface and a bottom surface, comprising the steps of:

affixing a CD to a shaft having an upper and a lower end, the shaft extending through the CD aperture, the shaft having a cap on its upper end contacting the CD top surface;

engaging the shaft lower end to a source of downward pulling force;

with the downward pulling source, pulling the shaft downward toward a surface bearing the self adhesive label such that the cap exerts a downward force on the CD top surface impelling the CD toward the surface; and contacting the CD bottom surface with the self adhesive label so as to affix the label to the CD.

24. The method of claim 23, wherein the source of downward pulling force is a trigger mechanism coupled to the shaft lower end.

25. The method of claim 24, wherein the surface defines a plane and the shaft lower end extends below the plane of the surface bearing the self adhesive label.

26. The method of claim 23, wherein the step of affixing the CD further comprises inserting the cap through the CD aperture so as to affix the CD to the shaft upper portion.

* * * * *